US005764214A

United States Patent [19]

Takano

[11] Patent Number: 5,764,214

[45] Date of Patent: Jun. 9, 1998

[54] WINDOW DISPLAY CONTROL APPARATUS IN A WINDOW SYSTEM AND WINDOW DISPLAY CONTROLLING METHOD

[75] Inventor: Hajime Takano, Tokyo, Japan

[73] Assignee: NEC Corporation, Tokyo, Japan

[21] Appl. No.: 326,853

[22] Filed: Oct. 21, 1994

[30] Foreign Application Priority Data

Oct. 21, 1993 [JP] Japan ..... 5-263879

[51] Int. Cl.[6] ..... G09G 5/00

[52] U.S. Cl. ..... 345/112; 345/340

[58] Field of Search ..... 345/112, 113, 345/115, 118, 119, 120, 146, 145, 185, 203; 395/155, 156, 160, 161, 162, 163, 340, 343, 346, 347, 348, 349, 350, 351

[56] References Cited

U.S. PATENT DOCUMENTS 4,931,957 6/1990 Takagi et al. ..... 345/113

*Primary Examiner*—Xiao Wu
*Attorney, Agent, or Firm*—Foley & Lardner

[57] ABSTRACT

A window display control apparatus in a window system includes a display control unit for controlling display processing of a window, and an application unit for issuing a frame display operation command. The display control unit stores a display control attribute table where a display control attribute indicative of a kind of display processing and an attribute value specified for each display control attribute are defined. The display control unit selects a display control attribute and an attribute value from the display control attribute table based on a screen display operation command issued from the application unit, and generates a display processing sequence indicative of a display processing procedure based on the selected attribute value, while executing frame display processing on a display unit in accordance with the generated display processing sequence. The application unit issues a display operation command which designates a kind of a display control attribute in response to a display processing request.

8 Claims, 7 Drawing Sheets

FIG.5

501 DISPLAY CONTROL ATTRIBUTE TABLE

| 502 DISPLAY CONTROL ATTRIBUTE | 503 ATTRIBUTE VALUE | |
|---|---|---|
| COMMON | PROCESSING CYCLE 10 STEPS PER SECOND | 503a |
| DISPLAY | WIPE 1 SECOND | 503b |
| ERASE | FADE-OUT 3 SECONDS | 503c |
| SCROLL | LINEAR SCROLLING 2 SECONDS | 503d |
| RE-SIZE | NO SUPPLEMENT | 503e |

FORMAT OF DISPLAY OPERATION COMMAND

FORMAT OF DISPLAY OPERATION COMMAND

WINDOW DISPLAY CONTROL APPARATUS IN A WINDOW SYSTEM AND WINDOW DISPLAY CONTROLLING METHOD

BACKGROUND OF THE INVENTION

1. Field of the Invention

The present invention relates to a window display control apparatus in a window system which produces visual effects such as wipe, fade-in/fade-out, and zoom-in/zoom-out by sequentially changing the display state of a window, and a method of controlling window displays.

2. Description of the Related Art

One of the most popular screen display systems currently in use is the X-Window System, a window system to run on the UNIX OS (see, for example, Oliver Jones and Toru Nishimura (ed.), X-Window Hand Book, published by ASCII Corp. in 1990). Typically, the X-Window System is composed of an X-server for practically executing screen display processing, and an X-client for issuing screen display instructions according to a behavior of an application. The screen display instructions and processing thereof consist of a function of managing the window such as generation, destruction and modification of the window, and a function of drawing graphic primitives in the window.

In the display control system for use in the X-Window System, which produces visual effects such as wipe, fade-in/fade-out and zoom-in/zoom-out by sequentially changing the display state, an X-server comprises a display processing portion for practically executing drawing processing, and an X-client comprises a display instruction portion for issuing screen display instructions to the X-server, a display control portion for controlling the change of the screen and an attribute storage portion for storing attributes of screen display control.

Herein, defined as the display control attributes are kinds of display operations to be executed (wipe, fade-in/fade-out, zoom-in/zoom-out, etc.), and processing times of visual effects, wipe patterns, etc. are defined as attribute values corresponding to these kinds.

Description will be given of the operation for a wipe display in the display control system set forth above. First, in an application unit serving as the X-client, a display control attribute stored in advance in the attribute storage portion is read out. Based on an attribute value of wipe display described in the display control attribute, the display control portion generates a display processing sequence indicative of a procedure of the display processing to be executed during the display operation. For example, a display processing sequence for the display using wipe is represented by mask updating including tens of steps, where tens of frames are sequentially displayed.

According to a frame description of the display processing sequence, the display control portion of the X-client issues a display command including a mask updating instruction and a screen display instruction to the X-server through the display instruction portion. Upon receiving the display command including the mask updating instruction and the screen display instruction, the X-server updates the screen by using the display processing portion.

The foregoing display command issuance and screen updating processing will be repeated until the end of the frames of the display processing sequence, that is, as many times as the number of frames. As a result, commands are sent/received between the X-server and the X-client (application unit) tens of times.

In addition, in order to produce visual effects such as fade-in/fade-out more smoothly, the display updating processing should be executed approximately 30 times per second. It is therefore necessary for conventional systems to issue a display command 30 times per second.

In the above-described system, commands for updating screen displays should be sequentially issued in a short time period. This requires numerous CPU processings to reduce an overall throughput of the system as a result. In the X-Window System, the speed of the interprocess communication for use in sending/receiving commands between the X-server and the X-client (application unit) is lower than that of function call in a process etc., causing reduction of performance, particularly in a network.

In addition, providing the display control portion for controlling visual effects and the attribute storage portion for storing display control attributes in each application is providing the same function block at a plurality of positions, which results in consuming a large amount of memory and disc capacities.

A further disadvantage is that no display processing can be executed other than that specified by a combination of predetermined display control attributes. For example, fade-out of the window needs a display control attribute related to the translucent display of the window. If such a display control attribute is not given, there arises the need of expanding capabilities to sacrifice compatibility with the system currently in use.

Furthermore, storing display control attributes in the display control portion will result in losing flexibility to modify or expand a display control behavior.

SUMMARY OF THE INVENTION

A first object of the present invention is to provide a screen display control system and a method of controlling displays by which reduction of a system throughput caused by an overhead in sending/receiving commands between a display control unit and an application unit can be minimized while maintaining compatibility with the system at the time of complicated display processing such as visual effects.

A second object of the present invention is to provide a screen display control system and a method of controlling displays which allow the amount of memory and disc needed for the system to be minimized as a whole by reducing the volume of attribute data to be stored in a display attribute storage portion while saving the necessity of preparing display control attributes in each application unit and by placing a portion related to the control of display updating processing in a display control unit in place of the application unit to reduce the size of the application unit.

A third object of the present invention is to provide a screen display control system and a method of controlling displays which allow a change of display control attributes for each object to improve the degree of freedom of display styles of an application unit and to have flexibility to expand and modify display updating processing as a result by preparing a plurality of display control attribute tables and appropriately selecting them at the time of display updating.

According to one aspect of the invention, a screen display control system for executing display updating processing includes displaying means for executing screen display; display controlling means for controlling display processing on the displaying means; and an application unit for issuing a screen display operation command.

The display controlling means includes:

a display attribute storing means for storing a display control attribute table where a display control attribute indicative of a kind of display processing and an attribute value specified for each of the frame display control attribute are defined. There is also provided a display processing sequence generating means responsive to a screen display operation command issued from the application unit for selecting the display control attribute and the attribute value from the display control attribute table and generating a display processing sequence indicative of a display processing procedure based on the selected attribute value.

Also provided is a display updating processing means for executing screen display processing on the displaying means in accordance with the generated display processing sequence. The application unit includes display instructing means responsive to a display processing request for issuing the display operation command which designates a kind of the display control attribute.

In the preferred construction, the application unit includes display attribute selecting means for determining, prior to the issuance of the screen display operation command by the display instructing means, whether there exists said display control attribute suited for a display processing request in the display control attribute table stored in the display attribute storing means. When the determination is made that no suitable display control attribute exists, the display control attribute table is generated whose contents are suited for the display processing request and storing the table in the display attribute storing means.

Also, the display attribute storing means stores a plurality of the display attribute tables including different display control attributes and attribute values. The application unit comprises display attribute selecting means for determining, prior to the issuance of the screen display operation command by the display instructing means, whether there exists the display control attribute suited for a display processing request in the plurality of display control attribute tables stored in the display attribute storing means. When the determination is made that no suitable display control attribute exists, the display control attribute table is generated whose contents are suited for the display processing request and the table is stored in the display attribute storing means.

In the above-mentioned construction, the application unit includes display attribute selecting means for determining, prior to the issuance of the screen display operation command by the display instructing means, whether there exists the display control attribute suited for a display processing request in the display control attribute table stored in the display attribute storing means. When no suitable display control attribute exists, it further determines whether there exists the display control attribute whose contents are proximate to the display processing request, and when no display control attribute exists with the proximate contents, it generates the display control attribute table whose contents are suitable for the display processing request and stores the table in the display attribute storing means, and when the display control attribute exists with the proximate contents, it selects the display control attribute with the proximate contents. Also included is an attribute updating means for updating the attribute value of the display control attribute having the contents proximate to the display processing request selected by the display attribute selecting means, based on the display processing request.

Also, the display attribute storing means stores a plurality of the display attribute tables including different display control attributes and attribute values.

The application unit includes display attribute selecting means for determining, prior to the issuance of screen display operation command by said display instructing means, whether there exists said display control attribute suited for a display processing request in the plurality of the display control attribute tables stored in the display attribute storing means. When no suitable display control attribute exists, it further determines whether there exists the display control attribute whose contents are proximate to the display processing request. When no display control attribute exists with the proximate contents, it generates the display control attribute table whose contents are suited for the display processing request and stores the table in the display attribute storing means. When the display control attribute exists with the proximate contents, it selects the display control attribute with the proximate contents.

There is also provided an attribute updating means for updating said attribute value of the display control attribute having the contents proximate to the display processing request selected by the display attribute selecting means, based on the display processing request.

According to one aspect of the invention, a method of controlling screen displays for executing display updating processing includes display controlling means for controlling display processing on displaying means; and an application unit for issuing a frame display operation command.

The display controlling means includes display attribute storing means for storing a display control attribute table where a display control attribute indicative of a kind of display processing and an attribute value specified for each of the display control attribute are defined. The display controlling means selects the display control attribute and the attribute value from the display control attribute table based on the frame display operation command issued from the application unit and generates a display processing sequence indicative of a display processing procedure based on the selected attribute value.

It also executes frame display processing on the displaying means in accordance with the generated display processing sequence.

The application unit issues the display operation command for designating a kind of the display control attribute in response to a display processing request.

In the above-mentioned construction, the application unit determines, prior to the issuance of the frame display operation command by the display instructing means, whether there exists the display control attribute suited for a display processing request in the display control attribute table stored in the display attribute storing means.

The application unit generates the display control attribute table whose contents are suited for the display processing request when no suited display control attribute exists.

Also, the display attribute storing means stores a plurality of the display attribute tables including different display control attributes and attribute values.

The application unit determines, prior to the issuance of the frame display operation command by the display instructing means, whether there exists the display control attribute suited for a display processing request in the plurality of the display control attribute tables stored in the display attribute storing means.

When no suited display control attribute exists, the application unit generates the display control attribute table whose contents are suited for the display processing request.

In the above-mentioned construction, the application unit determines, prior to the issuance of the frame display operation command by the display instructing means, whether there exists the display control attribute suited for a display processing request in the display control attribute table stored in the display attribute storing means.

When no suitable display control attribute exists, the application unit further determines whether there exists the display control attribute whose contents are proximate to the display processing request.

When no display control attribute having the proximate contents exists, the application unit generates the display control attribute table having the contents suited for the display processing request and stores the table in the display attribute storing means.

When there exists the display control attribute having the proximate contents, the application unit selects the display control attribute having the proximate contents; and updates the attribute value of said selected display control attribute whose contents are proximate to the display processing request based on the display processing request.

Also, the display attribute storing means stores a plurality of the display attribute tables including different display control attributes and attribute values.

The application unit determines, prior to the issuance of the frame display operation command by the display instructing means, whether there exists the display control attribute suited for a display processing request in the plurality of the display control attribute tables stored in the display attribute storing means.

When no suitable display control attribute exists, the application unit further determines whether there exists the display control attribute whose contents are proximate to the display processing request.

When no display control attribute having the proximate contents exists, the application unit generates the display control attribute table whose contents are suited for the display processing request and stores the table in the display attribute storing means.

When there exists the display control attribute having the proximate contents, the application unit selects the display control attribute having the proximate contents.

The application unit updates said attribute value of the selected display control attribute having the contents proximate to the display processing request, based on said display processing request.

Other objects, features and advantages of the present invention will become clear from the detailed description given herebelow.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings:

FIG. 5 is a diagram showing an example of an arrangement of a display control attribute table.

DESCRIPTION OF THE PREFERRED EMBODIMENTS

Figure 1:
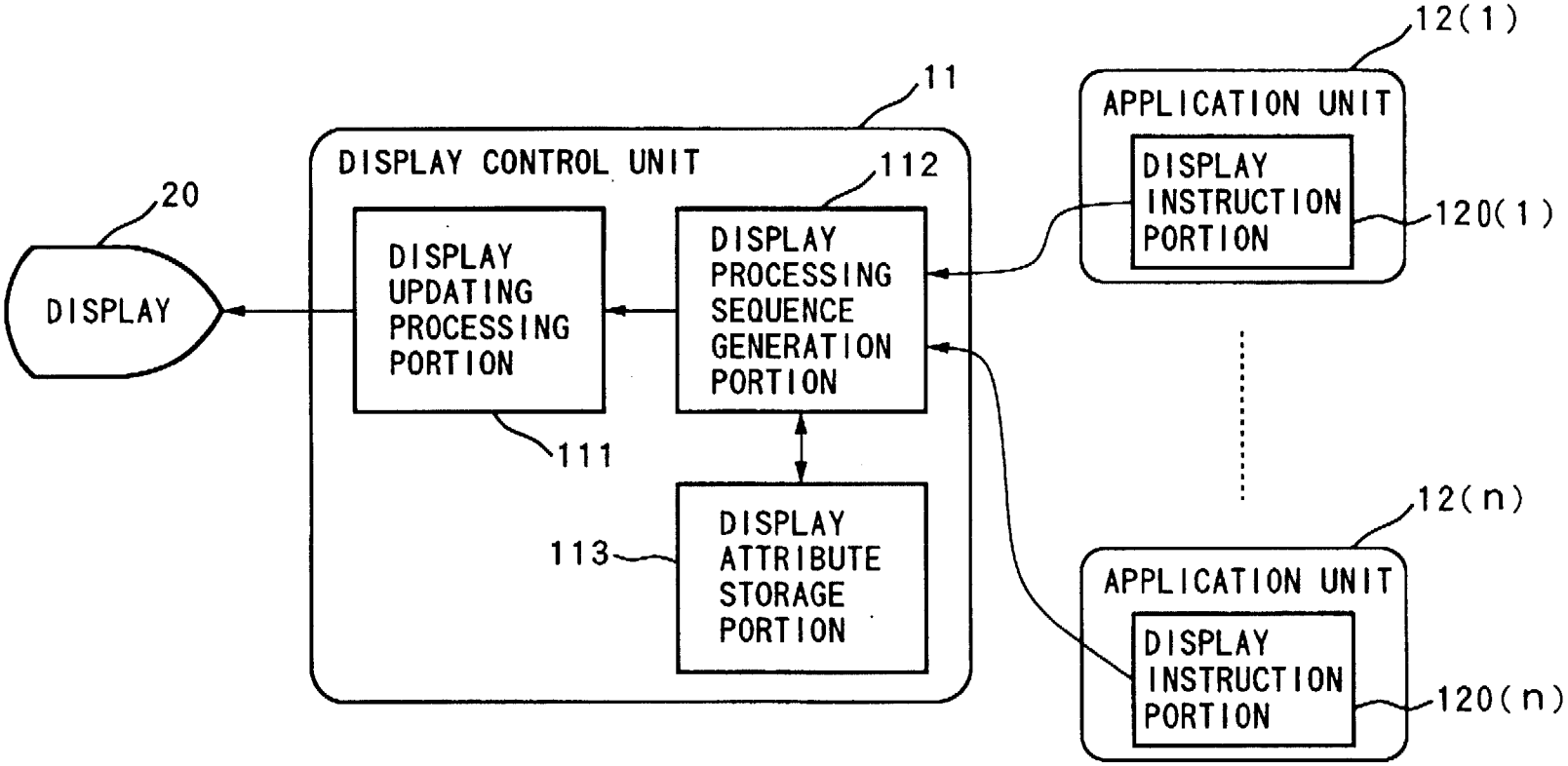
FIG. 1 is a block diagram showing an arrangement of a screen display control system according to a first embodiment of the present invention.
Figure 2:
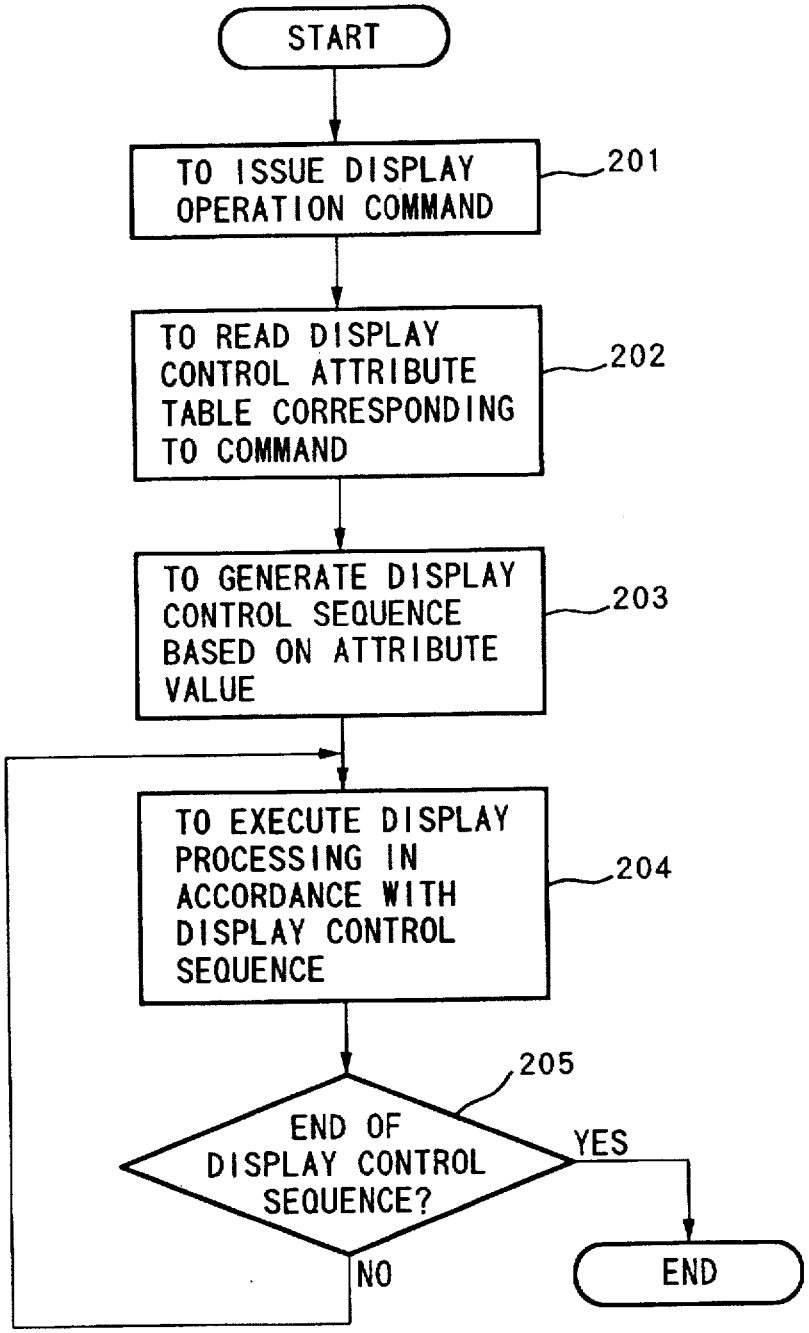
FIG. 2 is a flow chart illustrating the contents of display processing of the screen display control system according to the first embodiment of the present invention.

Preferred embodiments of the present invention will be descried in detail with reference to the accompanying drawings. FIG. 1 is a block diagram showing a system arrangement of the screen display control system according to a first embodiment, and FIG. 2 is a flow chart illustrating the contents of display control processing to be executed by the screen display control system.

With reference to FIG. 1, the screen display control system of the present embodiment, which produces visual effects such as wipe, fade-in/fade-out and zoom-in/zoom-out by sequentially changing the display state of the screen, comprises a display control unit 11, a plurality of application units 12(1) to **12(*n*) and a display 20**.

The plurality of the application units 12(1) to **12(*n*) respectively include display instruction portions 120(1) to 120(*n*)** for giving instructions on the modification of the display state (e.g., displaying, erasing, scrolling, re-sizing of the window).

Provided in the display control unit 11 are a display attribute storage portion 113 for storing in advance a display control attribute table to be referred to at the time of updating the display state, a display processing sequence generation portion 112 responsive to display operation commands issued by the display instruction portions 120(1) to **120(*n*) for generating a display processing sequence indicative of a procedure of the display processing based on the display control attributes stored in the display attribute storage portion 113, and a display updating processing portion 111 for executing screen display updating processing on the display 20**.

In the screen display control system implemented by the X-Window System, the display control unit 11 and the application units 12(1) to **12(*n*) are equivalent to an X-server and an X-client, respectively. Sending/receiving the commands between the display control unit 11 and the application units 12(1) to 12(*n*)** is carried out through the interprocess communication.

FIG. 5 is a diagram showing an example of a display control attribute table 501 to be stored in the display attribute storage portion 113. In the display control attribute table 501, a display control attribute 502 is for designating a kind of display operation (e.g., displaying, erasing, scrolling, re-sizing of the window) to be executed. Defined corresponding to the display control attributes 502 in the display control attribute table 501 are various attribute values 503 including a processing time of visual effects, wipe patterns (contents and times of processings such as wipe, fade-in/fade-out, zoom-in/zoom-out). In FIG. 5, **503*a* to 503*e* are defined as the contents of the attribute values 503**.

A procedure of display processing initiated by a display operation to be executed based on the above-described display control attributes is referred to as a display sequence.

Figure 6:
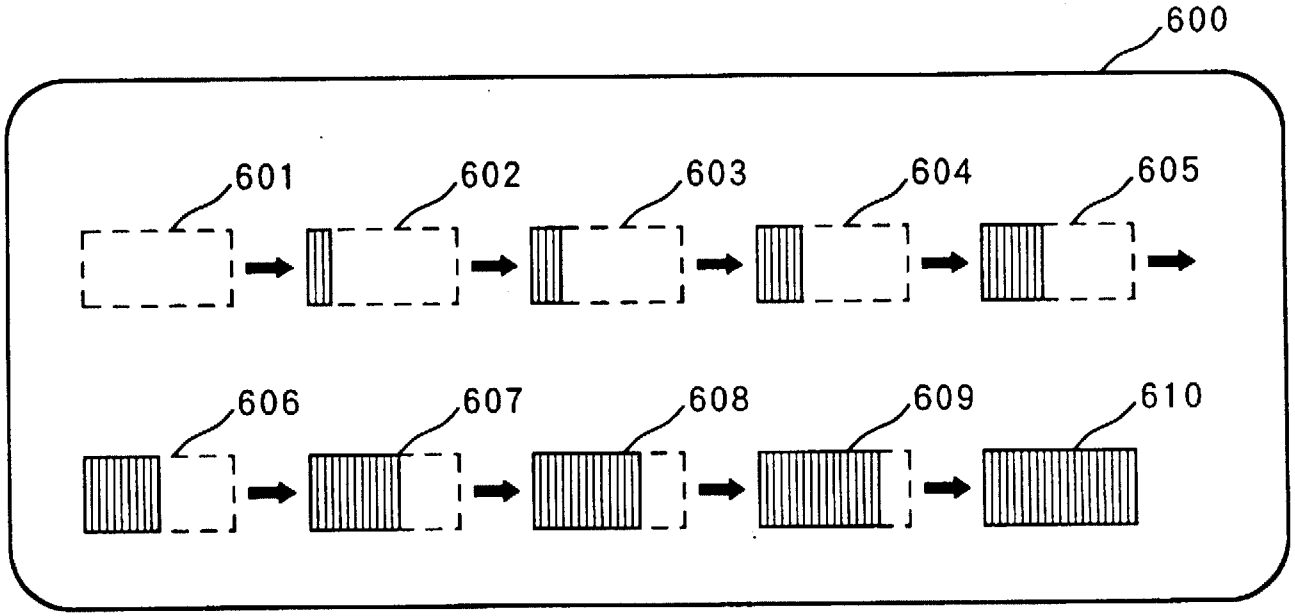
FIG. 6 is a diagram showing an example of a display processing sequence.

FIG. 6 is a diagram showing one example of a display control sequence for wipe display. FIG. 6 is an illustration of one example of a display processing sequence for displays using wipe, where a display processing sequence 600 is represented by mask updating including 10 steps from a frame 601 to a frame 610.

Now, operation of the frame display control system according to the first embodiment will be described with reference to FIGS. 1 and 2, and FIGS. 5 and 6. By way of example, description will be given of display processing by the application unit 12(1) out of the plurality of the application units.

First, the display control attribute table 501, which is to be referred to at the time of display updating, is stored in advance in the display attribute storage portion 113.

Figure 7:
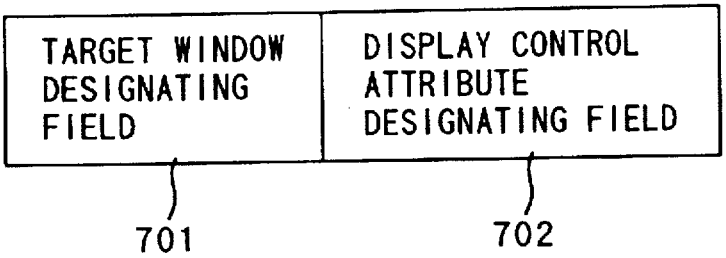
FIG. 7 is a diagram showing an example of a format of a display operation command according to the first embodiment.

In each application unit 12(1), the display instruction portion 120(1) then issues a display operation command (display of the window) to the display processing sequence generation portion 112 of the display control unit 11 (Step 201). The display operation command designates a kind of display control attribute corresponding to a display processing by the application unit 12(1). One example of a format of the display operation command is shown in FIG. 7. As can be seen in FIG. 7, the display operation command consists of a field 701 for designating a window whose display is to be updated, and a field 702 for designating a display control attribute (attributes other than a common display control attribute) indicative of the contents of processing for display updating.

Upon receiving the display operation command (window display) issued in Step 201, the display processing sequence generation portion 112 reads out attribute values **503*b* to 503*e* related to the display control attributes designated by the display operation command and a common attribute value 503*a* from the display control attribute table 501 of the display attribute storage portion 113 (Step 202) and generates such display processing sequence 600 as shown in FIG. 6 based on the read attribute values 503*b* to 503*e* and the common attribute value 503*a* (Step 203). For example, with a display operation command for the window display using wipe, the display processing sequence generation portion 112 generates the display processing sequence 600 for executing window display using wipe based on the attribute value of the wipe display described in the display control attribute table 501**.

The display updating processing portion 111 executes mask updating processing and frame display processing step by step according to the definitions of the frames 601 to 610 of the display processing sequence generated in Step 203 and outputs the result to the display 20 (Step 204). Determination is made as to whether the display processing sequence 600 is terminated (up to frame 610) or not (Step 205). If not terminated, Step 204 will be repeated. If the processing is finished, the entire processing will end. The other application units operate in the same manner.

In the above-described system of the present embodiment, since display updating processing is executed in the display control unit 11 based on the display control attributes preset in the display control attribute table in response to only one issuance of a display operation command by the display instruction portions 120(1) to **120(*n*) of the application units 12(1) to 12(*n*), no reduction of the system throughput is caused by overhead in sending/receiving commands between the display control unit 11 and the application units 12(1) to 12(*n*)**.

In a network, in particular, since one display operation needs only one command, no performance degradation is caused even when the application units 12(1) to **12(*n*) and the display control unit 11** are provided at different positions in the low-speed network.

Also in a case where a plurality of application units 12(1) to **12(*n*) are provided, sharing the display control attributes of the display attribute storage portion 113 obviates the need to prepare attributes for each of the application units 12(1) to 12(*n*), thereby reducing the volume of attribute data to be stored in the display attribute storage portion 113**.

In the first embodiment, since the sequential display updating processing is carried out based on the display control attribute values preset in the display control unit 11, the application units 12(1) to **12(*n*) only need to issue a display operation command for initiating the display updating processing to the display control unit 11**.

In order to produce visual effects such as fade-in/fade-out more smoothly, display updating processing should be executed approximately 30 times per second. It is therefore necessary for conventional systems to issue a display command 30 times a second. On the other hand, in the present embodiment, once a display operation command for designating a display control attribute is issued, the display updating processing is sequentially executed in the display control unit 11. Each of the application units 12(1) to **12(*n*) therefore needs to issue a display operation command only once to the display control unit 11**. In particular, the present embodiment system helps such systems as the X-Window System employing interprocess communication function for the connection between an application unit and a display control unit to reduce the total load on the system.

In addition, by providing portions related to the control of display updating processing in the display control unit 11 in place of the application units 12(1) to **12(*n*), the size of each of the application units 12(1) to 12(*n*)** can be reduced to decrease the amount of memory and disc needed for a system as a whole. This effect becomes more conspicuous as more application units are provided.

Figure 3:
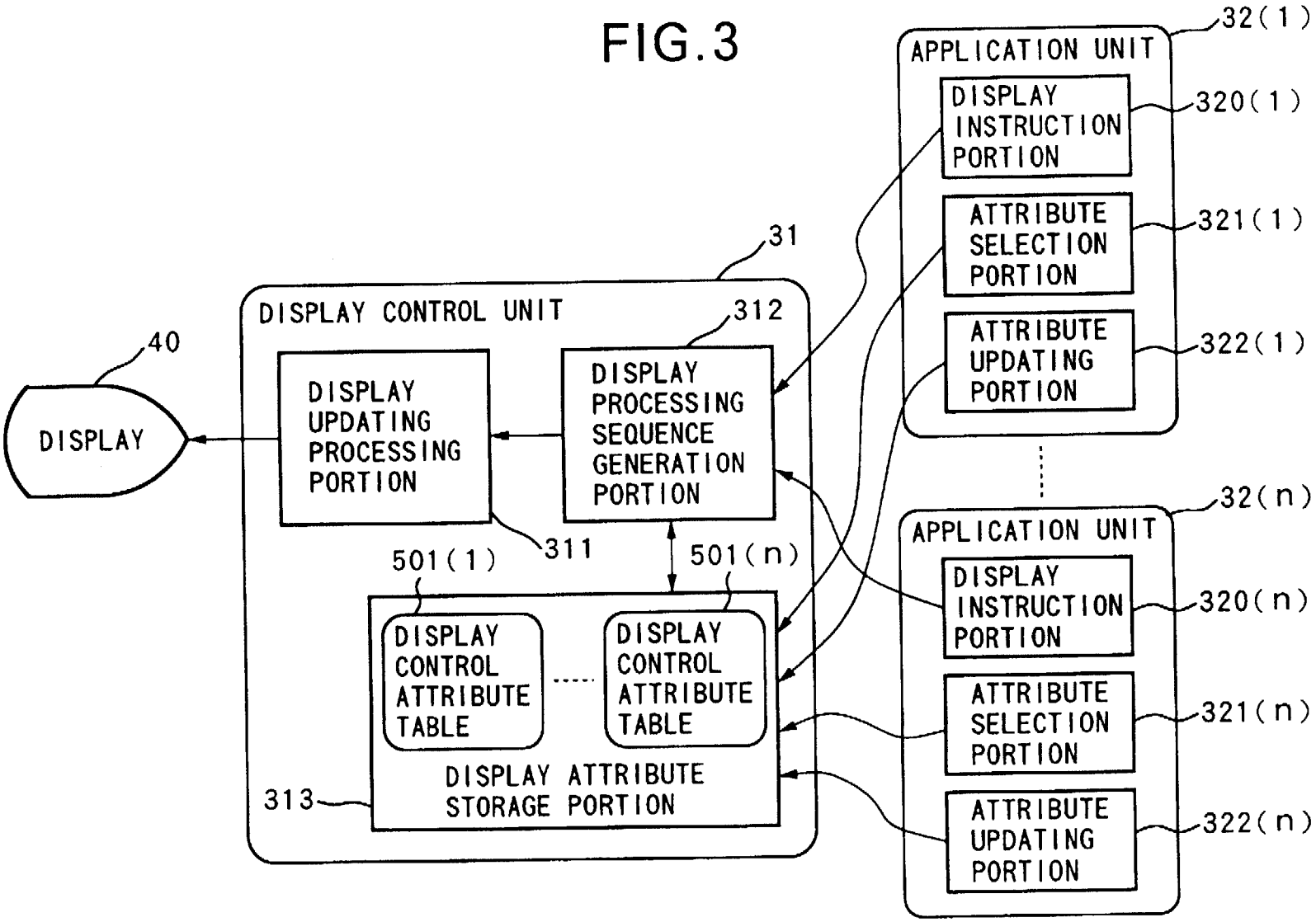
FIG. 3 is a block diagram showing an arrangement of a screen display control system according to a second embodiment.

An arrangement of a display control system according to a second embodiment of the present invention is shown in FIG. 3. The display control system of the second embodiment is comprised of a display control unit 31, a plurality of application units 32(1) to **32(*n*) and a display 40**.

In addition to display instruction portions 320(1) to **320(*n*) for giving instructions on the modification of the display state (e.g., occurrence, erasing, scrolling and re-sizing of the window) as recited in the first embodiment, the plurality of the application units 32(1) to 32(*n*) comprise attribute selection portions 321(1) to 321(*n*) for selecting a table to be used among the plurality of display control attribute tables stored in a display attribute storage portion 313 and generating a new display control attribute table, when necessary, to store it in the display attribute storage portion 313, and attribute updating portions 322(1) to 322(*n*) for updating (modify, add) a display control attribute and an attribute value included in the display control attribute table selected by the attribute selection portions 321(1) to 321(*n*) among the attributes stored in the display attribute storage portion 313**.

The display control unit 31 comprises the display attribute storage portion 313 for storing a plurality of display control attribute tables in advance, a display processing sequence generation portion 321 responsive to a display operation command for generating a display processing sequence indicative of a procedure of display processing based on the display control attributes stored in the display attribute storage portion 313, and a display updating processing portion 311 for executing frame display updating processing on the display 40. Unlike the first embodiment, the display attribute storage portion 313 of the display control unit 31 stores a plurality of display control attribute tables 501(1) to **501(*n*)** to be selected.

Figure 4:
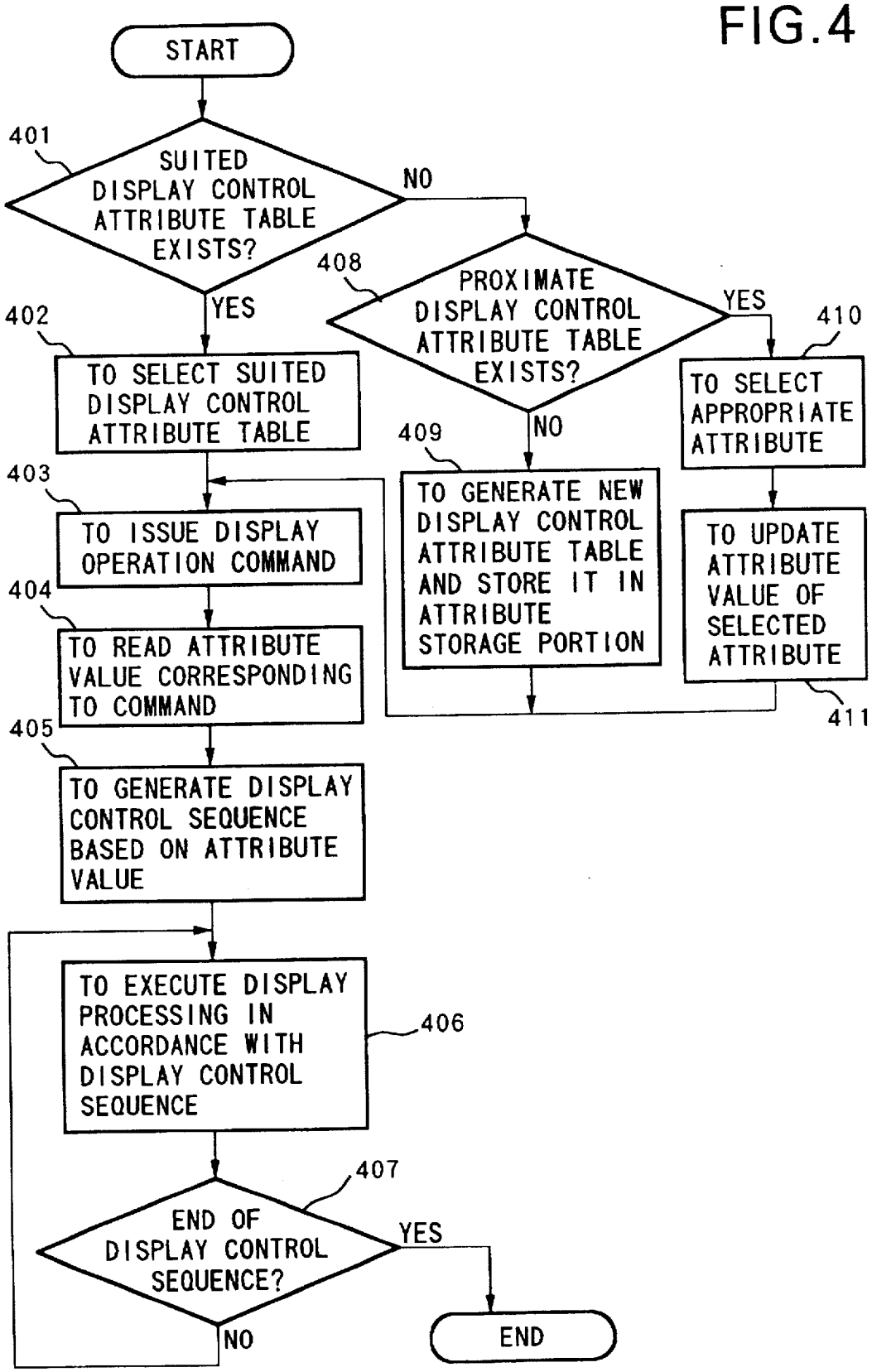
FIG. 4 is a flow chart illustrating the contents of display processing of the screen display control system according to the second embodiment.

Operation of the frame display control system according to the second embodiment will be described with reference to the flow chart of FIG. 4. By way of example, description will be given of display processing by the application unit 32(1) out of the plurality of application units.

First, the plurality of the display control attribute tables 501(1) to **501(*n*), which have a probability of being referred to at the time of display updating, are stored in advance in the display attribute storage portion 313 of the display control unit 31**.

Then, in response to a display processing request from the application unit 32(1), the attribute selection portion 321(1) makes a determination whether there exists a display control attribute table suited for the display processing request from the application unit 32(1) among the display control attribute tables stored in the display attribute storage portion 313 (Step 401). In other words, the determination is made whether there exits such a display control attribute table as shown in FIG. 5 whose display control attribute and attribute value agree with those of the tables stored in the display attribute storage portion 313.

When the determination is made that the suited display control attribute table exists, the routine proceeds to Step 402. When it does not exist, the routine branches off to Step 408.

When no suited display control attribute exists in Step 401, further determination is made whether there exists a display control attribute table including a display control attribute and an attribute value proximate to the display processing request from the application unit 32(1) (Step 408). If no display control attribute table exists having a display control attribute and an attribute value proximate to the display processing request, the routine proceeds to Step 409, and if it exists, the routine branches off to Step 410. Through Step 409 or 410, the routine proceeds to Step 403.

When in Step 408 there exists no display control attribute table having a display control attribute and an attribute value proximate to the display processing request, the attribute selection portion 321(1) newly generates a display control attribute table to which a display control attribute and an attribute value suited for the display processing request are set, and stores the table in the display attribute storage portion 313 (Step 409).

For example, when the display processing request from the application unit 32(1) is for wipe display of the window and there exists in the display attribute storage portion 313 no display control attribute table including a display control attribute and an attribute value related to wipe display, determination is made in Step 401 that no suited display control attribute exists and in Step 408 that no display control attribute table exists which has a display control attribute and an attribute value proximate to the display processing request. Then, in Step 409, a new display control attribute table including a display control attribute and an attribute value related to wipe display is generated and stored in the display attribute storage portion 313.

When in Step 408 a display control attribute table exists which has a display control attribute and an attribute value proximate to the display processing request, the attribute selection portion 321(1) selects the display control attribute table having the display control attribute and the attribute value proximate to the display processing request from the display attribute storage portion 313 (Step 410). The attribute updating portion 322(1) then updates the relevant display control attribute and attribute value of the selected display control attribute table (Step 411).

For example, when the display processing request from the application unit 32(1) is for wipe display of the window and there exists in the display attribute storage portion 313 no display control attribute table including a display control attribute related to wipe display with a different attribute value, determination is made in Step 401 that no suited display control attribute exists, and in Step 408 that there exists a display control attribute table including a display control attribute and an attribute value proximate to the display processing request. Then, in Steps 410–411, the attribute value of the display control attribute related to wipe display is updated to agree with the display processing request.

When there exists in Step 401 a display control attribute table suited for the display processing request from the application unit 32(1), the attribute selection portion 321(1) selects the suited display control attribute table (Step 402).

Figure 8:
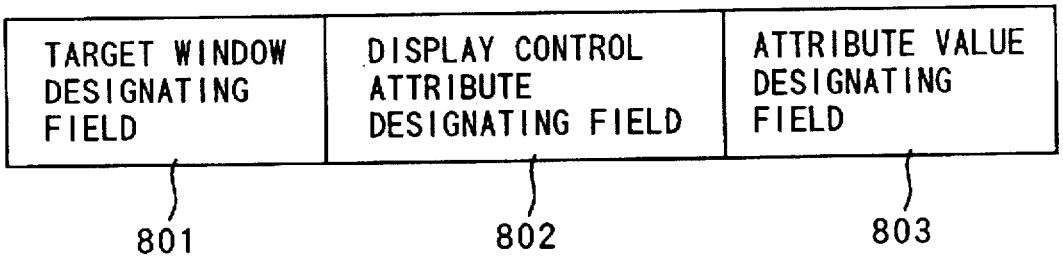
FIG. 8 is a diagram showing an example of a format of a display operation command according to the second embodiment.

After the execution of any required processing in the foregoing, the display instruction portion 321(1) issues a display operation command indicating a display control attribute and an attribute value suited for the display processing request by the application unit 32(1) to the display processing sequence generation portion 312 of the display control unit 31 based on the selected display control attribute table (or a newly generated display control attribute table or an updated display control attribute table) (Step 403). One example of a format of a display operation command to be issued in the second embodiment is shown in FIG. 8. As illustrated in FIG. 8, the display operation command consists of a field 801 for specifying a target window whose display is to be updated, a field 802 for specifying a display control attribute (attributes other than a common display control attribute) indicative of the contents of processing for display updating, and a field 803 for specifying an attribute value of the display control attribute.

The display processing sequence generation portion 312 reads a display control attribute and an attribute value specified by the display operation command issued in Step 403 from a predetermined display control attribute table (Step 404), and generates a display processing sequence based on the attribute value (Step 405).

The display updating processing portion 311 executes the display updating processing step by step in accordance with the display processing sequence generated in Step 405, and outputs the result to the display 40 (Step 406). Then, determination is made whether the display processing sequence is terminated or not (Step 407). If not terminated, Step 406 will be repeated, and if it is terminated, the entire processing will end. The other application units operate in the same manner.

The above-described system according to the second embodiment enables modification of display control attributes for each object by preparing a plurality of display control attributes and selecting appropriate one of them at the time of updating displays, whereby the degree of freedom of display styles of an application unit can be improved.

Although the present invention has been described in detail with respect to the preferred embodiments in the foregoing, it will be understood that the present invention is not limited thereto. In the present embodiment, for example, a display processing sequence is generated in a display processing unit based on a display control attribute corresponding to a display operation command. However, it is apparent that the present invention is also applicable to a case where a display sequence is generated on an application side and then loaded into a display processing unit. In addition, connection between the display processing unit and the application unit needs not be made by interprocess communication. It is also possible to implement the present invention in various functions such as function call without difficulty.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A window display apparatus in a window system for executing display updating processing comprising:

displaying means for executing screen display;

display controlling means for controlling display processing of a window on said displaying means; and an application unit for issuing a screen display operation command for the window;

said display controlling means including:

display attribute storing means for storing a display control attribute table where a display control attribute indicative of a kind of display processing of the window and an attribute value specified for each of said display control attribute are defined;

display processing sequence generating means responsive to a screen display operation command issued from said application unit for selecting said display control attribute and said attribute value from said display control attribute table and sequentially generating a display processing sequence indicative of a display processing procedure of said window based on said selected attribute value; and display updating processing means for executing screen display processing of said window on said displaying means in accordance with said generated display processing sequence; and said application unit including display instructing means responsive to a display processing request for issuing said display operation command which designates a kind of said display control attribute;

wherein said application unit further comprises display attribute selecting means for determining, prior to the issuance of said screen display operation command by said display instructing means, whether there exists said display control attribute suited for a display processing request in said display control attribute table stored in said display attribute storing means, and when the determination is made that no suited display control attribute exists, generating said display control attribute table whose contents are suited for said display processing request and storing the table in said display attribute storing means.

2. A window display control apparatus in a window system for executing display updating processing comprising:

displaying means for executing screen display;

display controlling means for controlling display processing of a window on said displaying means; and an application unit for issuing a screen display operation command for the window;

said display controlling means including:

display attribute storing means for storing a display control attribute table where a display control attribute indicative of a kind of display processing of the window and an attribute value specified for each of said display control attribute are defined;

display processing sequence generating means responsive to a screen display operation command issued from said application unit for selecting said display control attribute and said attribute value from said display control attribute table and sequentially generating a display processing sequence indicative of a display processing procedure of said window based on said selected attribute value; and display updating processing means for executing screen display processing of said window on said displaying means in accordance with said generated display processing sequence; and said application unit including display instructing means responsive to a display processing request for issuing said display operation command which designates a kind of said display control attribute;

wherein said display attribute storing means stores a plurality of said display attribute tables including different display control attributes and attribute values, and said application unit further comprises display attribute selecting means for determining, prior to the issuance of said screen display operation command by said display instructing means, whether there exists said display control attribute suited for a display processing request in said plurality of display control attribute tables stored in said display attribute storing means and when the determination is made that no suited display control attribute exists, generating said display control attribute table whose contents are suited for said display processing request and storing the table in said display attribute storing means.

3. A window display control apparatus in a window system for executing display updating processing comprising:

displaying means for executing screen display;

display controlling means for controlling display processing of a window on said displaying means; and an application unit for issuing a screen display operation command for the window;

said display controlling means including:

display attribute storing means for storing a display control attribute table where a display control attribute indicative of a kind of display processing of the window and an attribute value specified for each of said display control attribute are defined;

display processing sequence generating means responsive to a screen display operation command issued from said application unit for selecting said display control attribute and said attribute value from said display control attribute table and sequentially generating a display processing sequence indicative of a display processing procedure of said window based on said selected attribute value; and display updating processing means for executing screen display processing of said window on said displaying means in accordance with said generated display processing sequence; and said application unit including display instructing means responsive to a display processing request for issuing said display operation command which designates a kind of said display control attribute;

wherein said application unit further comprises:

display attribute selecting means for determining, prior to the issuance of said screen display operation command by said display instructing means, whether there exists said display control attribute suited for a display processing request in said display control attribute table stored in said display attribute storing means, and when no suited display control attribute exists, further determining whether there exists said display control attribute whose contents are proximate to said display processing request, and when no display control attribute exists with the proximate contents, generating said display control attribute table whose contents are suited for said display processing request and storing the table in said display attribute storing means and when said display control attribute exists with the proximate contents, selecting said display control attribute with the proximate contents; and attribute updating means for updating said attribute value of said display control attribute having the contents proximate to said display processing request selected by said display attribute selecting means, based on said display processing request.

4. A window display control apparatus in a window system for executing display updating processing comprising:

displaying means for executing screen display;

display controlling means for controlling display processing of a window on said displaying means; and an application unit for issuing a screen display operation command for the window;

said display controlling means including:

display attribute storing means for storing a display control attribute table where a display control attribute indicative of a kind of display processing of the window and an attribute value specified for each of said display control attribute are defined;

display processing sequence generating means responsive to a screen display operation command issued from said application unit for selecting said display control attribute and said attribute value from said display control attribute table and sequentially generating a display processing sequence indicative of a display processing procedure of said window based on said selected attribute value; and display updating processing means for executing screen display processing of said window on said displaying means in accordance with said generated display processing sequence; and said application unit including display instructing means responsive to a display processing request for issuing said display operation command which designates a kind of said display control attribute;

wherein said display attribute storing means stores a plurality of said display attribute tables including different display control attributes and attribute values, and said application unit further comprises:

display attribute selecting means for determining, prior to the issuance of said screen display operation command by said display instructing means, whether there exists said display control attribute suited for a display processing request in the plurality of said display control attribute tables stored in said display attribute storing means, and when no suited display control attribute exists, further determining whether there exists said display control attribute whose contents are proximate to said display processing request, and when no display control attribute exists with the proximate contents, generating said display control attribute table whose contents are suited for said display processing request and storing the table in said display attribute storing means and when said display control attribute exists with the proximate contents, selecting said display control attribute with the proximate contents; and attribute updating means for updating said attribute value of said display control attribute having the contents proximate to said display processing request selected by said display attribute selecting means, based on said display processing request.

5. A method of controlling window displays for executing display updating processing comprising the steps of:

controlling display processing of a window on displaying means; and issuing a screen display operation command for the window in an application unit;

storing a display control attribute table in a display attribute storing means, where a display control attribute indicative of a kind of display processing of the window and an attribute value specified for each of said display control attribute are defined;

selecting said display control attribute and said attribute value from said display control attribute table based on the screen display operation command issued from said application unit and sequentially generating a display processing sequence indicative of a display processing procedure of said window based on said selected attribute value; and executing screen display processing of said window on said displaying means in accordance with said generated display processing sequence;

issuing said display operation command for designating a kind of said display control attribute in response to a display processing request in said application unit;

prior to the issuance of said screen display operation command by said application unit, determining whether there exists said display control attribute suited for a display processing requested in said display control attribute table stored in said display attribute storing means, and generating, in said application unit, said display control attribute table whose contents are suited for said display processing request when no suited display control attribute exists.

6. A method of controlling window displays for executing display updating processing comprising the steps of:

controlling display processing of a window on displaying means; and issuing a screen display operation command for the window in an application unit;

storing a display control attribute table in a display attribute storing means, where a display control attribute indicative of a kind of display processing of the window and an attribute value specified for each of said display control attribute are defined;

selecting said display control attribute and said attribute value from said display control attribute table based on the screen display operation command issued from said application unit and sequentially generating a display Processing sequence indicative of a display processing procedure of said window based on said selected attribute value; and executing screen display processing of said window on said displaying means in accordance with said generated display processing sequence; and issuing said display operation command for designating a kind of said display control attribute in response to a display processing request in said application unit;

said display attribute storing means storing a plurality of display attribute tables including different display control attributes and attribute values, and determining prior to the issuance of said screen display operation-command from said application unit, whether there exists said display control attribute suited for a display processing request in the plurality of said display control attribute tables stored in said display attribute storing means; and when no suited display control attribute exists, generating said display control attribute table whose contents are suited for said display processing request.

7. A method of controlling window displays for executing display updating processing comprising the steps of:

controlling display processing of a window on displaying means; and issuing a screen display operation command for the window in an application unit;

storing a display control attribute table in a display attribute storing means, where a display control attribute indicative of a kind of display processing of the window and an attribute value specified for each of said display control attribute are defined;

selecting said display control attribute and said attribute value from said display control attribute table based on the screen display operation command issued from said application unit and sequentially generating a display processing sequence indicative of a display processing procedure of said window based on said selected attribute value; and executing screen display processing of said window on said displaying means in accordance with said generated display processing sequence; and issuing said display operation command for designating a kind of said display control attribute in response to a display processing request in said application unit;

determining prior to the issuance of said screen display operation command from said application unit, whether there exists said display control attribute suited for a display processing request in said display control attribute table stored in said display attribute storing means;

determining, when no suited display control attribute exists, whether there exists said display control attribute whose contents are proximate to said display processing request;

generating, when no display control attribute having the proximate contents exists, said display control attribute table having the contents suited for said display processing request and storing the table in said display attribute storing means;

selecting, when there exists said display control attribute having the proximate contents, said display control attribute having said proximate contents; and updating said attribute value of said selected display control attribute whose contents are proximate to said display processing request based on said display processing request.

8. A method of controlling window displays for executing display updating processing comprising the steps of:

controlling display processing of a window on displaying means; and issuing a screen display operation command for the window in an application unit;

storing a display control attribute table in a display attribute storing means, where a display control attribute indicative of a kind of display processing of the window and an attribute value specified for each of said display control attribute are defined;

selecting said display control attribute and said attribute value from said display control attribute table based on the screen display operation command issued from said application unit and sequentially generating a display processing sequence indicative of a display processing procedure of said window based on said selected attribute value; and executing screen display processing of said window on said displaying means in accordance with said generated display processing sequence; and issuing said display operation command for designating a kind of said display control attribute in response to a display processing request in said application unit;

said display attribute storing means storing a plurality of display attribute tables including different display control attributes and attribute values, and determining prior to the issuance of said screen display operation command from said application unit, whether there exists said display control attribute suited for a display processing request in the plurality of said display control attribute tables stored in said display attribute storing means;

when no suited display control attribute exists, further determining whether there exists said display control attribute whose contents are proximate to said display processing requests;

when no display control attribute having the proximate contents exists, generating said display control attribute table whose contents are suited for said display processing request and storing the table in said display attribute storing means;

when there exists said display control attribute having the proximate contents, selecting said display control attribute having said proximate contents; and updating said attribute value of said selected display control attribute having the contents proximate to said display processing request, based on said display processing request.

* * * * *